United States Patent [19]

Kawam

[11] 3,950,960

[45] Apr. 20, 1976

[54] PROCESS FOR STORING A LIQUEFIED GAS FOR ITS DISTRIBUTION IN GASEOUS FORM

[75] Inventor: Antoine Kawam, Washington, D.C.

[73] Assignee: S.T. Dupont, Paris, France

[22] Filed: Nov. 21, 1974

[21] Appl. No.: 525,974

[30] Foreign Application Priority Data

Nov. 22, 1973 France ..... 73.41626

[52] U.S. Cl. ..... 62/48; 222/3; 431/344

[51] Int. Cl.[2] ..... F17C 11/00

[58] Field of Search ..... 62/48, 45, 50; 55/74, 55/316; 431/344; 222/3

[56] References Cited

UNITED STATES PATENTS 2,472,825 6/1949 Head ..... 431/344

3,252,270 5/1966 Pall et al. ..... 55/74

Foreign Patents or Application

485,632 1/1918 France

*Primary Examiner*—William F. O'Dea
*Assistant Examiner*—Ronald C. Capossela
*Attorney, Agent, or Firm*—Haseltine, Lake & Waters

[57] ABSTRACT

A process for storage of a liquefied gas on an adsorbant support in a chamber provided with at least one discharge orifice for the distribution of the gas in gaseous form into an environment at a pressure lower then the storage pressure. The adsorbant support is constituted of hollow capillary fibres, natural or synthetic, such as kapok fibers. The hollow capillary fibers have an inner diameter between about 10 to 35$\mu$ and a wall thickness about 0.2 to 3$\mu$. The actual volume of the fibers represents about 11% of the storage chamber.

9 Claims, 4 Drawing Figures

30
25
20
15
10
5
2
1
25%
50%
75%
100%
0
5
10
15
20
25
30
32
30
25
20
15
10
5
0

PROCESS FOR STORING A LIQUEFIED GAS FOR ITS DISTRIBUTION IN GASEOUS FORM

BACKGROUND

1. Field of the Invention

The invention relates to the storage of a liquefied gas in a chamber provided with at least one discharge orifice for its distribution in gaseous form into an environment whose pressure is less than the storage pressure.

2. Prior Art

It is conventional to store such liquefied gas by combining it, in a storage chamber, with an adsorbant support. Many supports have been proposed for this purpose among which include: cotton, peat, diverse fibers, cellulosic materials, etc. in order to facilitate the distribution in the gaseous state of a great number of liquefied gases among which include carbon dioxide, ammonia, hydrogen sulphide and especially gaseous hydrocarbons under normal conditions of temperature and pressure. Such gases, because they are combustible, are known for inumerable uses.

Applicant has proposed in French application No. 71/32946 filed Sept. 13, 1971, and in certificates of addition attached thereto to utilize adsorbant supports of a particular type, namely polymers on which the liquid phase of the gas to be distributed acts as a swelling solvent. The advantages of this type of support are that the liquefied gas adsorbed by the polymer is liberated only in gaseous form.

In French application No. 73/36495, filed Oct. 12, 1973, there are defined better conditions of utilization of conventional adsorbant supports, fibrous or of open cells, in order not for increasing the stored amount of gas in liquid form in the storage chamber, but to obtain a distribution exclusively in gaseous form. U.S. application Ser. Nos. 515,035 and 515,036, filed on Oct. 15, 1974, in the name of Talloneau correspond to the latter said French Application and are commonly assigned with the present Application.

SUMMARY OF THE INVENTION

In pursuing these studies in this field, Applicant has discovered unexpectedly that known materials, namely hollow capillary fibers, can also be advantageously utilized as an adsorbant support for the storage of liquefied gas in order to facilitate its distribution in gaseous form, and under certain conditions, which will be defined hereafter, to assure a distribution exclusively in gaseous state.

Therefore, an object of the present invention is to provide a process for storing a liquefied gas in the presence of an adsorbant support in a chamber provided with at least one discharge orifice for the distribution of the gas in gaseous state into an environment of lower pressure than the storage pressure, wherein the said adsorbant support is constituted of hollow capillary fibers, natural or synthetic.

As just indicated, the fibers which can be utilized are indifferently natural or synthetic. Among the first group can be mentioned for example, kapok fibers, i.e. down fibers which surround the grains of certain rare trees and whose principal use up to the present was for filling cushions and life preservers. With regard to hollow synthetic fibers, mention can be made notably of polypropylene fibers.

Advantageously, the utilized fibers will have both an inside diameter between about 10 to 35$\mu$ and a wall thickness of between about 0.2 and 3$\mu$.

In the case of kapok, Applicant has found that for fibers having the dimensions just mentioned, there is obtained a distribution exclusively in a gaseous state when the actual volume of the kapok fibers in the storage chamber represents about 11% of the volume of the storage chamber.

The advantageous properties of these hollow fibers, with respect to solid fibers conventionally utilized in the art probably results, without the exactness of this assertion having any effect whatsoever on the invention, from the fact that the surfaces for contact by the liquid phase are considerably increased. In addition to this advantage, the hollow capillary fibers permit the storage of a much greater quantity of gas than solid fibers for the same actual volume and for the same diameter while always providing a distribution exclusively in gaseous state. Finally, it is important to mention that natural fibers such as kapok are widely distributed, which from an economic point of view gives a further advantage.

DESCRIPTION OF PREFERRED EMBODIMENTS

The advantages of the hollow capillary fibers as an adsorbant support for the storage of liquefied gas follow from the subsequent tests effected with liquefied butane having a density of 0.57 g/cm$^3$ under normal conditions of utilization and with kapok fibers in bulk, i.e. loosely entangled in three dimensions with a mean inner diameter of 22$\mu$, a mean thickness of 1$\mu$ and an actual density of 1 g/cm$^3$. The tests were run with a chamber having a free volume of 32 cm$_3$ at whose discharge orifice there was provided a burner which was not in contact with the adsorbant support. The steps of the process were the following:

filling the chamber with liquefied butane;

purging the chamber by opening a valve situated at the lower part of the chamber until butane no longer leaves in liquid phase; and weighing the chamber to determine the weight of adsorbed butane.

The butane utilized for these tests was commercial quality butane whose exact composition in % by weight was as follows:

n-butane: 78%
isobutane: 20%
propane: 1.5%
butene, isobutene, pentanes: 0.5%

The results obtained are summarized in the following table:

| Weight in grams of liquefied butane | Volume in cm$^3$ of liquefied butane | Weight in grams of kapok | Actual volume in cm$^3$ of kapok |
|---|---|---|---|
| 6.4 | 12.2 | 1.2 | 1.2 |
| 12.0 | 21.0 | 2.3 | 2.3 |
| 12.0 | 21.0 | 6.1 | 6.1 |
| 12.8 | 22.5 | 5.1 | 5.1 |
| 13.3 | 23.3 | 4.5 | 4.5 |
| 13.4 | 23.5 | 2.95 | 2.95 |
| 13.8 | 24.2 | 3.5 | 3.5 |

Analogous tests were effected for the purpose of comparison with cotton fibers of a diameter of 10 to 23 microns disposed in bulk.

The results of these comparative tests are shown in one of the figures of the annexed drawings.

DETAILED DESCRIPTION

Figure 1:
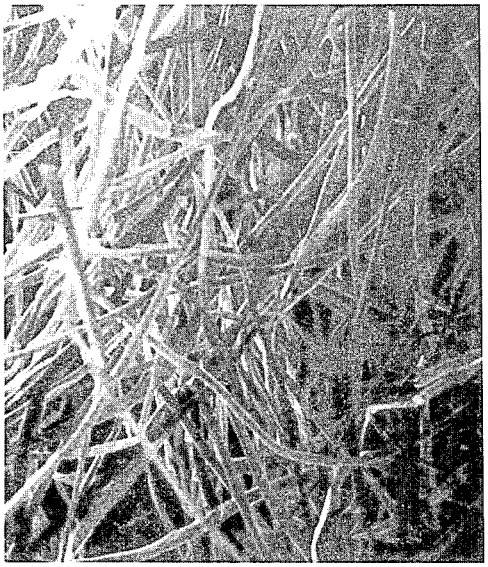
FIG. 1 is a photograph, enlarged 100 times of kapok fibers utilized in the tests.
Figure 2:
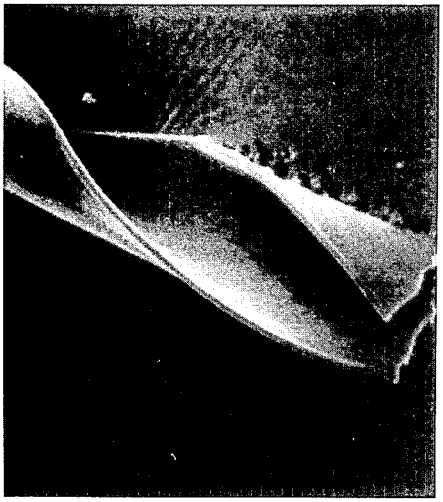
FIG. 2 is a photograph on a much greater scale (enlarged 1350 times) of an isolated kapok fiber one part of the wall of which has been broken away to show its structure.
Figure 3:
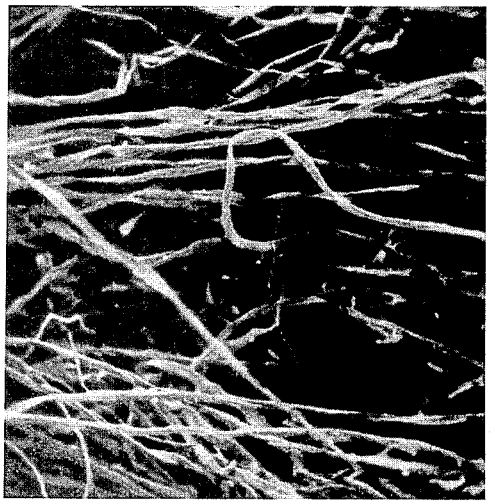
FIG. 3 is a photograph enlarged 100 times of cotton fibers utilized in the comparative tests.
Figure 4:
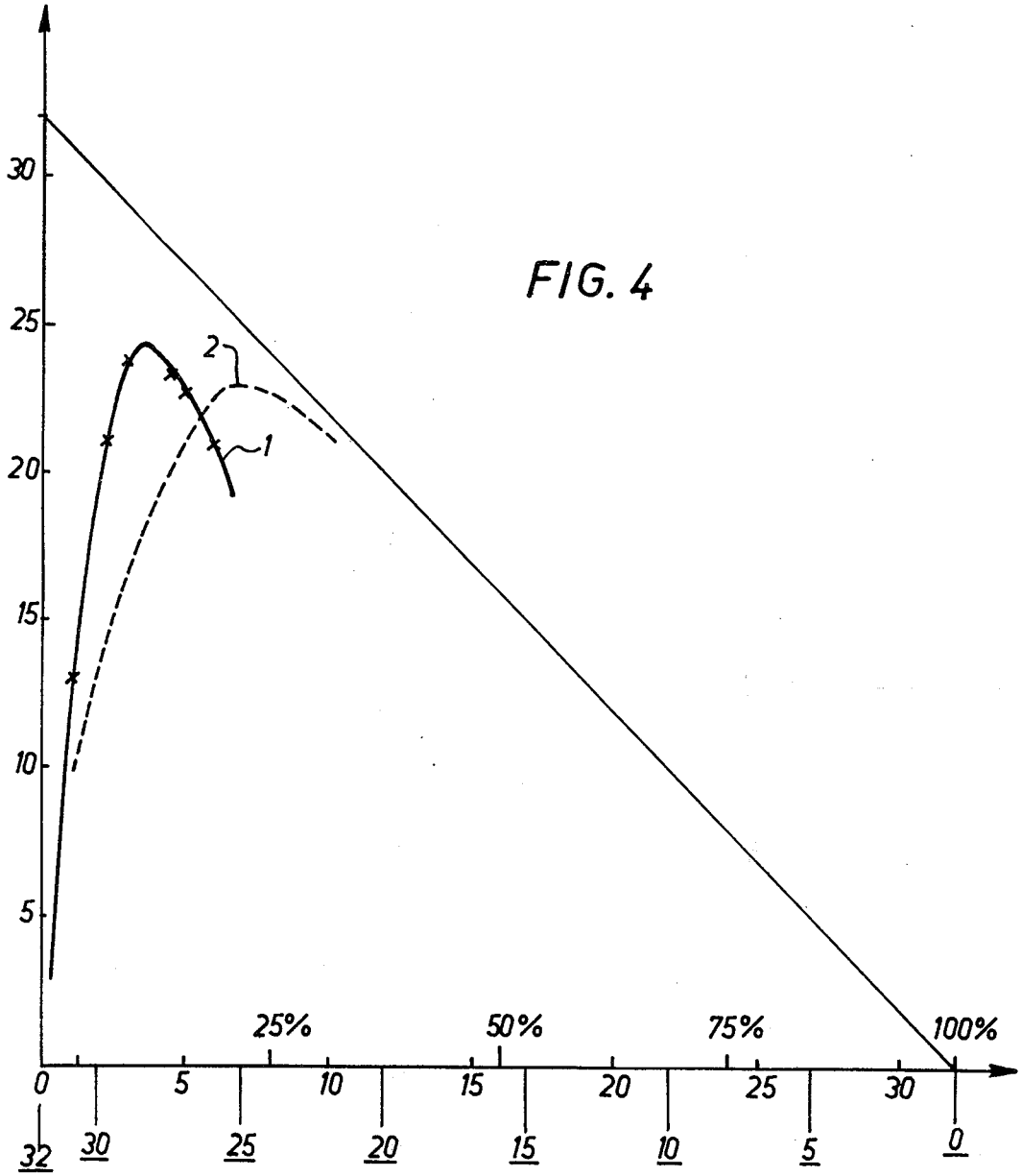
FIG. 4 is a graph illustrating the results of these tests.

The graph in FIG. 4 shows, in the form of curves, the volume of adsorbed butane expressed in $cm^3$ as a function of the actual volume of the adsorbant support for the same apparant volume. As it is practically impossible to determine and measure each free space in a capillary mass more or less compressed, there is shown on the graph (non-underlined numbers along the abscissa) the actual volume of the adsorbant supports, as well as the percentage of the volume of the chamber which these actual volumes represent.

The volume of the free spaces in which it is possible to store the butane is equal to the difference between the total volume of the chamber and the actual volume of the adsorbant support contained in this chamber and it becomes possible to show on the same curve, the volume of said free spaces. This is why on the same graph, there is shown, below the abscissa a scale of underlined numbers giving this volume.

The ordinate represents the volume of adsorbed butane.

Curve 1 refers to tests effected with kapok, whereas curve 2 corresponds to tests with cotton. These curves clearly show the superiority of kapok fibers over cotton fibers. It should nevertheless be noted that the filling of the chamber with liquid butane requires a longer time for kapok fibers than for cotton fibers, However, with the kapok fibers, the effects of capillarity of the liquified butane against the walls of the chamber are much less sensitive and significant as with cotton.

What is claimed is:

1. In a process for storing a liquefied gas in the presence of an adsorbant support in a chamber provided with at least one discharge orifice for the distribution of the gas into an environment at a pressure lower than the storage pressure, an improvement wherein said adsorbant support is constituted of hollow capillary fibers providing means whereby said fibers can adsorb a greater quantity of liquefied gas with substantially smaller volume as compared to solid fibers for release of the gas exclusively in gaseous form into said environment.

2. A Process as claimed in claim 1 wherein said capillary fibers are selected from the group consisting of natural and synthetic fibers.

3. A Process as claimed in claim 1 wherein said hollow capillary fibers are kapok fibers.

4. A Process as claimed in claim 1 wherein said hollow capillary fibers are polypropylene fibers.

5. A Process as claimed in claim 1 wherein said hollow capillary fibers have an inner diameter between about 10 to $35\mu$ and a wall thickness between about 0.2 to $3\mu$.

6. A Process as claimed in claim 5 wherein the hollow capillary fibers are kapok fibers whose actual volume represents about 11% of the storage chamber.

7. A Process as claimed in claim 1 wherein the stored gas comprises at least one normally gaseous hydrocarbon.

8. A Process as claimed in claim 1 wherein said stored gas is butane.

9. A Process as claimed in claim 1 wherein said fibers are loosely entangled in three dimensions to form a loose mass for said adsorbant support.

* * * * *